US007838485B2

(12) United States Patent
Heisig et al.

(10) Patent No.: US 7,838,485 B2
(45) Date of Patent: Nov. 23, 2010

(54) BIODEGRADABLE ALKALINE DISINFECTANT CLEANER WITH ANALYZABLE SURFACTANT

(75) Inventors: Christopher C. Heisig, St. Louis, MO (US); Shahin Keller, St. Louis, MO (US); John Macauley, Golden Eagle, IL (US); Gurusamy Manivannan, St. Charles, MO (US); Daniel Klein, Shiloh, IL (US); Michael Ebers, O Fallon, MO (US)

(73) Assignee: American Sterilizer Company, Mentor, OH (US)

( * ) Notice: Subject to any disclaimer, the term of this patent is extended or adjusted under 35 U.S.C. 154(b) by 831 days.

(21) Appl. No.: 11/715,695

(22) Filed: Mar. 8, 2007

(65) Prior Publication Data

US 2008/0221006 A1 Sep. 11, 2008

(51) Int. Cl.
*C11D 1/825* (2006.01)
*C11D 7/06* (2006.01)
*C11D 3/33* (2006.01)

(52) U.S. Cl. ..... 510/422; 510/225; 510/228; 510/238; 510/252; 510/356; 510/365; 510/421; 510/480

(58) Field of Classification Search ..... 510/225, 510/228, 238, 252, 356, 365, 421, 422, 480
See application file for complete search history.

(56) References Cited

U.S. PATENT DOCUMENTS

| | | | | |
|---|---|---|---|---|
| H468 | H | 5/1988 | Malik et al. | |
| 5,767,056 | A | 6/1998 | Lenoir | |
| 5,837,667 | A | 11/1998 | Stabley | |
| 6,232,280 | B1 | 5/2001 | Shah et al. | |
| 6,247,478 | B1 | 6/2001 | Cords et al. | |
| 6,274,541 | B1 | 8/2001 | Man | |
| 6,479,453 | B2 | 11/2002 | Man | |
| 6,537,960 | B1 | 3/2003 | Ruhr et al. | |
| 6,541,442 | B1 | 4/2003 | Johansson et al. | |
| 6,581,613 | B2 | 6/2003 | Berkels et al. | |
| 7,037,884 | B2 | 5/2006 | Man | |
| 2003/0151022 | A1 * | 8/2003 | Bragulla et al. | 252/60 |
| 2005/0277564 | A1 | 12/2005 | Heise et al. | |
| 2006/0159730 | A1 | 7/2006 | Simon | |

* cited by examiner

*Primary Examiner*—Charles I Boyer
(74) *Attorney, Agent, or Firm*—Hudak, Shunk & Farine Co. LPA

(57) ABSTRACT

An aqueous, alkaline cleaning composition for use on hard-to-clean soils, encountered in pharmaceutical, personal care, food and cosmetic manufacturing, comprising a source of alkalinity, a biodegradable surfactant system further comprising one or more surfactants, one or more hydrotropes, and a UV-analyzable surfactant, and a biodegradable chelating agent. The composition offers unique advantages of stability over the expected shelf life, low-foaming property, phosphate-free and biodegradable components, and unexpectedly enhanced antimicrobial, including virucidal, activity in one cleaning composition. The UV-analyzable surfactant allows for validation of cleaning processes using known techniques for manufacturers who are required or desire to do so.

1 Claim, 3 Drawing Sheets

Comparison of Various Compositions and Individual Components

PRC 1B is an example of the inventive composition.

PKB is a surfactant booster

Comparison of DI Water and the Inventive Compositions against *S. aureus* ATCC 6538 11-10-06

ProKlenz One is a trade name for the inventive composition.

Comparison of NaOH and the Inventive Composition's Activity against *S. aureus* ATCC 6538 11-10-06

BIODEGRADABLE ALKALINE DISINFECTANT CLEANER WITH ANALYZABLE SURFACTANT

FIELD OF THE INVENTION

This invention relates to an aqueous, alkaline cleaning composition useful for hard-to-clean soils encountered in the pharmaceutical, personal care, food and cosmetic manufacturing industries, which itself has unexpected disinfectant (antimicrobial) properties, including virucidal efficacy. More particularly, this invention is directed to a stable, phosphate-free, aqueous alkaline cleaning composition comprising an alkalinity source, a biodegradable surfactant system, which is a combination of one or more nonionic surfactants, one or more hydrotropes, and a UV-analyzable surfactant, and a biodegradable chelating agent. The alkaline cleaning composition of the invention is prepared in concentrated form, which may be further diluted depending on application.

BACKGROUND OF THE INVENTION

Current cleaning practices in the pharmaceutical, personal care, food and cosmetic manufacturing industries involve the use of alkaline, acid and/or neutral pH detergent systems for cleaning and removal of various soil residues. Areas of cleaning include reactors, storage vessels, tanks, pipes and other stainless steel equipment, with or without Clean-in-Place (CIP) systems or manual scrubbing. Current cleaning chemistries involve different mechanisms, such as solubilization, wetting, emulsification, dispersion, chelation, and chemical or enzymatic hydrolysis, and other well known physical and chemical phenomena, in addition to reactive chemistries, for the purpose of removing unwanted soils. In general, many soils can be cleaned and removed using one of the aforementioned cleaning mechanisms, but some soils require cleaning methods involving a combination of two or more different mechanisms. Soils requiring a combination of multiple cleaning agents (mechanisms) may be classified as "difficult or hard-to-clean" soils. Types of soils in this category include, but are not limited to, various hydrophobic soils, polymers, silicone-based products, cosmetics or personal care products with complex formulations (e.g. water-proof mascara), proteins, and inorganic-based products.

Alkaline cleaners promote saponification of fatty soils, which aids cleaning efficiency and increases conductivity of the solution to aid in electrolytic processes. Highly alkaline cleaners are used, both for cleaning and sanitizing, for hard surface cleaning applications and for manufacturing equipment, including Clean-in-Place applications.

Alkaline cleaning compositions are well known in the art. By way of illustration only, U.S. Pat. No. 6,581,613 to Berkels et al. discloses a composition comprising 0.1-50% of a defined alkylpolyglucoside (D.P. 1.7 to 3 and an alkyl radical comprising 8 carbon atoms) and 50 to 99.9% of a concentrated alkali metal hydroxide solution, for use in breweries and dairies.

U.S. Pat. Nos. 6,274,541, 6,479,453 and 7,037,884 to Man disclose an alkaline cleaning composition comprising an alkyl or alkylaryl ethoxy carboxylate (0.1-20 wt. %), a strong chelating agent, such as NTA, EDTA, HEDTA, and DTPA, preferably EDTA (1-20 wt. %), and a source of alkalinity, preferably a combination of ammonia or ammonium hydroxide, monoethanolamine and sodium hydroxide (2-30 wt. %) stated to be especially effective for removing lime-soaps in greasy soils from hard quarry or ceramic tile.

H468 to Malik et al., a statutory invention record, discloses a process for cleaning a soiled hard surface by applying an alkaline cleaner comprising an alkalinity source 0.1-50 wt. % and an alkylglucoside (0.1 to 40 wt. %), which is stated to be superior to alkaline cleaning compositions comprising anionic and nonionic surfactants for hard surface cleaning. The formulation also contemplates the addition of phosphate builders and the use of water miscible solvents.

U.S. Pat. No. 6,541,442 to Johansson discloses an alkaline composition containing a high amount (up to 30 wt. %) of a nonionic alkylene oxide adduct surfactant and a hexyl glucoside as a hydrotrope, for use in cleaning hard surfaces, in a mercerization process, and to clean, desize and scour fibers and fabrics at a pH above 11. The composition also includes complexing agents, such as phosphates and NTA and EDTA.

U.S. Pat. No. 6,537,960 to Ruhr et al discloses a low-foaming surfactant blend for use in highly alkaline conditions comprising at least one $C_3$ to $C_{10}$ alkyl polyglucoside, at least one amine oxide, at least one polycarboxylated alcohol alkoxylate and at least one alcohol alkoxylate. The disclosed surfactant is stated to facilitate chlorine stability.

U.S. Pat. No. 5,767,056 to Lenoir discloses an aqueous alkaline composition comprising an alkali metal hydroxide and an addition reaction product of an alcohol having 6-18 carbon atoms, with either propylene oxide and ethylene oxide or butylene oxide and ethylene oxide, for cleaning surfaces of fruits, vegetables, containers for food, or for chemical peeling of fruit or vegetables, metal working or cotton mercerization.

Cleaning compositions with analyzable surfactants are also known in the art. For example, U.S. Pat. No. 6,232,280 to Shah et al. discloses a cleaning composition comprising, as its sole surfactant, a UV-analyzable surfactant in combination with a strong alkali.

Alkaline cleaning compositions of the prior art suffer from a number of disadvantages or drawbacks. While increased active alkali content is generally associated with improved cleaning performance, use of highly alkaline compositions has been limited due to the instability of various components included in the compositions to enhance their properties. In particular, certain oxidants, surfactants, hydrotropes, foaming agents and the like are difficult to incorporate into a highly alkaline composition, so that the final product is stable in storage for a reasonable shelf life. As a result, an optimal cleaning composition, comprising components necessary to remove "hard-to-clean" soils effectively has been difficult to achieve, much less one that also possesses antimicrobial activity. Further, dilution of concentrated, highly alkaline cleaning compositions often results in less than optimal cleaning performance.

There are other drawbacks to the use of current, commercially available alkaline cleaning products for manufacturing. Many detergent systems employ the use of chelating agents, such as tetrasodium ethylenediaminetetraacetate (EDTA) or nitrilotriacetate (NTA), which are not considered totally biodegradable. NTA has also been classified as a possible carcinogen to humans (Group 2B) by the Insecticide Restrictions Action Committee (IRAC)'s working group. Further, certain surfactants used in most alkaline cleaners are not biodegradable, and, therefore, cannot be used in certain geographic areas, such as for example Europe, due to regulatory restrictions (EU 648/2004). Thus, achieving cleaning efficacy required the use of components that are not environmentally friendly or safe.

Another major disadvantage with many prior art cleaning compositions is that it is often difficult to detect whether any cleaning solution or surfactant from the cleaning solution remains on the cleansed surface in order to validate the cleaning process. Manufacturers are often required to validate the cleaning process and assure consumers and regulatory agencies that contaminants from product residues or cleaning compositions, or both, do not adulterate or adversely affect the quality and safety of the next products made in the same production vessels. It is therefore critically important that the cleaning process effectively removes both product (soil) and cleaner residues from the equipment to avoid any cross contamination from one batch to another.

Validation of cleaning procedures is an FDA requirement for drug manufacturers. Detection of contaminants requires the use of suitable analytical methods for measuring an analyte at or below a present acceptance residue limit, including specific and nonspecific methods to determine the presence or absence of component of a cleaning solution, preferably an active compound or surfactant. Examples of specific methods that detect a unique compound in the presence of potential contaminants are, but not limited to: High Performance Liquid Chromatography (HPLC), ion chromatography, atomic absorption, Inductively Coupled Plasma Mass Spectrometry (ICP-MS), and capillary electrophoresis. Examples of non-specific methods are, but not limited to: total organic carbon (TOC), pH, acid/base titrations and conductivity.

It is a common practice to determine the level of residual cleaning product by a non-specific analytical method, such as Total Organic Carbon (TOC) analysis. This approach is limited, however, in that it only offers information about the water-soluble carbon content of all components in the residue and not about specific components in the cleaning product. Other non-specific methods suffer from the same disadvantages.

High Performance Liquid Chromatography (HPLC) is the method of choice for determining the level of residual pharmaceutical product on equipment. It is a highly effective and sensitive analytical technique to detect specific components not only of product residue, but also of the cleaning composition employed. Pharmaceutical companies often analyze rinse solutions (rinsate) using HPLC methods with UV detection. HPLC uses a combination of chromatography for separating the rinsate into components and UV/visible spectroscopy at a fixed wavelength for detection, depending on the component to be analyzed. HPLC is set up to detect for signals at two (or more) wavelengths—one corresponding to a known component of the pharmaceutical (or other chemical) product expected to be remaining in the equipment after processing, and one corresponding to the analyzable component of the cleaning composition. Identification of the analyzable component of the cleaning composition indicates whether the cleaning composition has been thoroughly removed from a surface or equipment, after the cleaning process.

The FDA requirements are covered under the 1963 GMP regulations (Part 133.4) and Section 211.67 in the 1978 CGMP regulations (211.67). The primary rationale for requiring clean equipment validation is to prevent adulteration of drug products. The regulations require companies to have written, standard operating procedures (SOPs) detailing the cleaning processes used for various pieces of equipment, a system for validation of the cleaning processes including predetermined limits or acceptance criteria and revalidation, and a final validation report. Cleaning validation procedures involve testing for residues in the manufacturing process, selection of residue detection methods, identification of residues, selection of sampling method, setting acceptance criteria for the residues, and methods validation and recovery studies. Although the FDA does not set acceptance specifications or methods for determining whether a cleaning process is validated, some limits that are prevalent in the industry as set forth in literature include analytical detection levels such as 10 ppm, biological activity levels, such as 1/1000 of the normal therapeutic dose, and organoleptic levels as no visible residue. It is impractical for the FDA to set specific acceptance specifications due to the wide variation in equipment and products that would need to be addressed. It is preferred in the pharmaceutical industry to use a detection method involving HPLC at concentrations of around 10 ppm or less, in addition to other available methods.

Many surfactants and other components employed in current commercially available cleaning compositions cannot be quantitatively analyzed/detected in the rinse solutions by companies who are required or desire to validate their cleaning processes. Most cleaning compositions do not contain a surfactant having an analyzable species, or chromophore, which can be detected by HPLC with UV detectors. A cleaning composition with a UV-analyzable surfactant offers dual advantages, since the same analytical procedure that is used to monitor for pharmaceutical (product) residues will be used to detect for surfactant and thus validate the cleaning process.

There are other disadvantages associated with currently available cleaning compositions used in the manufacturing industry. Some cleaning compositions include disinfectants and sanitizing components, which require separate post-cleaning treatments. Cleaning compositions containing these components are known to introduce issues of their own, including instability, foaming, residues, toxicity and incompatibility (e.g., phenolics, quaternium ammonium products, peroxides, sodium hypochlorite). It is desirable therefore to have a cleaning composition which itself has enhanced antimicrobial activity, but does not require the addition of known disinfectants or sanitizing agents or a separate sanitizing or disinfecting step to achieve that activity.

Therefore, there is a need for an effective cleaning composition(s) for hard-to-clean soils, which combines the advantages of the prior art compositions without the concomitant disadvantages associated with their use. In short, there is a need for effective cleaning composition(s) for hard-to-clean soils, which have superior cleaning performance to currently available products, are phosphate-free, biodegradable, non-toxic and non-carcinogenic, and can be easily validated through conventional techniques employed by manufacturers. There is also a need for such a composition to have hospital grade disinfectant properties, including virucidal efficacy, without the need for the addition of other sanitizing or disinfecting components or separate sanitizing or disinfecting steps. Such a composition would save time and costs, by eliminating the need for additional components or steps. Finally, it is also desirable that such a cleaning composition be stable for an extended shelf life, compatible with other cleaning components and low foaming.

A new alkaline cleaning composition has been developed, which is an improved, stable composition for use alone on hard-to-clean soils. The new composition comprises an alkalinity source, a synergistic combination of surfactants and other components that are phosphate-free and meet detergent regulations for biodegradability, are demonstrated to be stable in the formulation through accelerated stability testing at 50° C. for three months, and have unexpectedly enhanced antimicrobial, including virucidal, efficacy. The composition also contains a stable, UV-analyzable surfactant, which facilitates the detection of the cleaning product at low residue conditions, thus allowing for easy validation of the cleaning process by known techniques. Foam studies conducted on the new formulation, in both graduated cylinders and high-pressure washers at various temperatures and concentrations, showed that they were low foaming. The height of the foam in all cases was similar to currently available alkaline cleaners.

This novel composition offers significant advantages to the prior art in that the product exhibits: superior cleaning of hard-to-clean soils, i.e., effectiveness by itself against both polymeric and oily soils, reduced cleaning time, energy savings, and overall cost reduction; low or no environmental impact, as the composition is phosphate-free and the components of the formulation have proven, established biodegradability; the ability to analyze by HPLC-UV, thus allowing for direct measurement and quantification of the detergent residue and validation of the cleaning process; hospital grade disinfectant properties, including virucidal efficacy; and hard water tolerance.

SUMMARY OF THE INVENTION

The aqueous, alkaline cleaning compositions of the present invention comprise an alkalinity source in combination with other components that are environmentally friendly, i.e., biodegradable. "Biodegradable" means, but is not limited to, a structural change (transformation) of a component by microorganisms resulting in the loss of its properties due to the degradation of the parent substance and consequential loss of its properties. Specific to surfactants, the loss of properties is measure by the test methods listed in Annex 11, Official Journal of the European Union Aug. 4, 2004 (Article 2, Definitions 6 and 7).

The source of alkalinity is preferably sodium hydroxide (available as 50% active), which is an EPA-approved "active" ingredient, which means it is recognized as effective for use as an antimicrobial. Potassium hydroxide (46% active) can also be used as a source of alkalinity in place of sodium hydroxide, but it is not recognized by the EPA as an "active" ingredient. In one embodiment, both potassium hydroxide and sodium hydroxide may be combined as the source of alkalinity. The alkaline component not only has effective cleaning properties, but also is demonstrated to have disinfectant properties as well.

The aqueous, alkaline cleaning compositions of the present invention also utilize a surfactant system, which comprises a combination of biodegradable surfactants and hydrotropes. Preferably, nonionic, alcohol ethoxylate surfactants are used, along with a hydrotrope, although other biodegradable surfactants may be used as described herein. The hydrotrope is utilized to stabilize the combination of surfactants in order to allow them to remain soluble in the aqueous, alkaline composition. The hydrotrope is preferably an alkylglucoside or alkyl polyglucoside. The surfactant system allows for a multitude of cleaning mechanisms to attack hard-to-clean soils and works synergistically with other components to provide superior cleaning performance, stability over the expected shelf life, low foaming properties, and unexpectedly enhanced antimicrobial activity.

The aqueous, alkaline cleaning compositions of the invention also utilize a biodegradable chelating agent. The chelating agent has a positive impact on cleaning performance of the composition. The chelating agent is preferably trisodium methylglycine diacetic acid (MGDA), also known commercially as Trilon M, although other biodegradable chelating agents known in the art may be used.

An important aspect of the invention is the utilization of at least one ultraviolet light (UV) analyzable surfactant that contains a chromophore, such as a UV-analyzable aromatic functional group. Thus, at least one surfactant of the surfactant system of the inventive composition must be UV-analyzable. The analyzable surfactant is preferably sodium xylene sulfonate, although other UV-analyzable surfactants are known in the art and are within the scope of the invention, provided that the selected UV-analyzable surfactant is also biodegradable.

It is critical that the surfactant system be stable in alkaline conditions, meaning that the surfactants do not appreciably degrade over the expected storage time of the aqueous, alkaline cleaning composition. Stability is especially important for the selected UV-analyzable surfactant. Conventional surfactants used in cleaning products do tend to degrade over time due to highly alkaline or acidic pH of the product and thus are not capable of acting as a stable indicator during the entire life of the product. The present invention provides, among other advantages, an improved alkaline cleaning composition, which overcomes the instability of conventional surfactants in an alkaline solution.

The combination of the foregoing components results in a low-foaming, stable alkaline cleaning composition, which can be used for hard-to-clean soils in the pharmaceutical, personal care, cosmetic, food and other industries that require effective cleaning and validation using known methods, and which provides, at the same time, sanitizing and disinfecting without the addition of other components or a separate sanitizing or disinfecting step.

While the percentages for components of the aqueous, alkaline cleaning composition as described herein are considered optimal, some variation in range is permitted. It should be noted that these wider ranges for individual components of the inventive composition contemplates that the composition will be prepared as a concentrate with further dilution as necessary and required. Both the concentrate and diluted form are within the scope of the invention. All percentages used herein are wt. %, based upon the total weight of the composition, unless indicated otherwise.

In concentrate form, the source of alkalinity (sodium hydroxide (50% active) or potassium hydroxide (46% active)) is present in the alkaline cleaning composition in a range from about 25% to about 50%, based upon the total weight of the composition. The surfactant system combined (including hydrotrope) is present in the aqueous alkaline cleaning composition, in total, in a range of from about 4% to about 20%, also based upon the total weight of the composition. Specifically, the surfactants may be used in a range of from about 1% to about 10%, and the hydrotrope from about 1% to about 10%. The UV-analyzable surfactant is present in a range from about 0.5% to about 10%, and the chelating agent is present in a range from about 1% to about 20%.

It is contemplated that the concentrate form of the invention will be diluted as is customary depending upon application. Dilution is done at the time of use and has no effect on the advantageous properties including low-foaming, stability, biodegradability, antimicrobial activity, and the ability to be UV-analyzed. Moreover, a 1% dilution of the inventive aqueous, alkaline cleaning composition when tested met EPA requirements for a Non-Food Contact Hard Surface Sanitizing Agent (5 minutes, 3 log reduction). A 3% dilution met EPA disinfectant requirements.

Accordingly, in a preferred aspect of the invention, the aqueous alkaline cleaning composition comprises an alkaline base, a biodegradable surfactant system comprising, in addition to nonionic surfactants, a hydrotrope and a UV-analyzable surfactant, and a biodegradable chelating agent. More particularly, the inventive alkaline cleaning composition preferably comprises in concentrated form:

a. a source of alkalinity (from about 25 to about 50 wt. %);
b. a biodegradable surfactant system (from about 4 to about 20 wt. %), which further comprises at least one nonionic surfactant such as an alcohol ethoxylate, or preferably a mixture of alcohol ethoxylates (from about 1 to about 10 wt. %); a hydrotrope that is an alkylglucoside (from about 1 to about 10 wt. %); and a UV-analyzable surfactant that is sodium xylene sulfonate (from about 0.1 to about 10 wt. %);

c. a biodegradable chelating agent (from about 1 to about 20 wt. %); and d. water (up to 100 wt. %), wherein the cleaning composition is stable for an expected shelf life, low foaming, phosphate-free and biodegradable, capable of being validated using known detection techniques, and has disinfectant, including virucidal, properties when used alone without the need for addition of sanitizing or disinfecting components or a separate sanitizing or disinfecting step.

In another embodiment of the invention, the aqueous, alkaline cleaning composition comprises, in addition to the nonionic surfactants and other components set forth above, certain biodegradable amphoteric surfactants, such as a betaine or dipropionate, and/or anionic surfactants, such as modified ethoxylates (polymeric surfactants), in amounts ranging from 1 to 10 wt. %. The amphoteric and anionic surfactants, when used, may take the place or provide the functional equivalent of a hydrotrope and/or UV-analyzable surfactant.

While the aqueous alkaline cleaning compositions of the invention are low-foaming, optionally, foam depressants or low-foaming surfactants, may be added. Biodegradable foam depressants and low-foaming surfactants useful in the claimed inventions are well known to one skilled in the art.

BRIEF DESCRIPTION OF THE DRAWINGS

The invention will be better understood and other features and advantages will become apparent by reading the detailed description of the invention, taken together with the drawings, wherein.

DETAILED DESCRIPTION OF THE INVENTION

Figure 1:
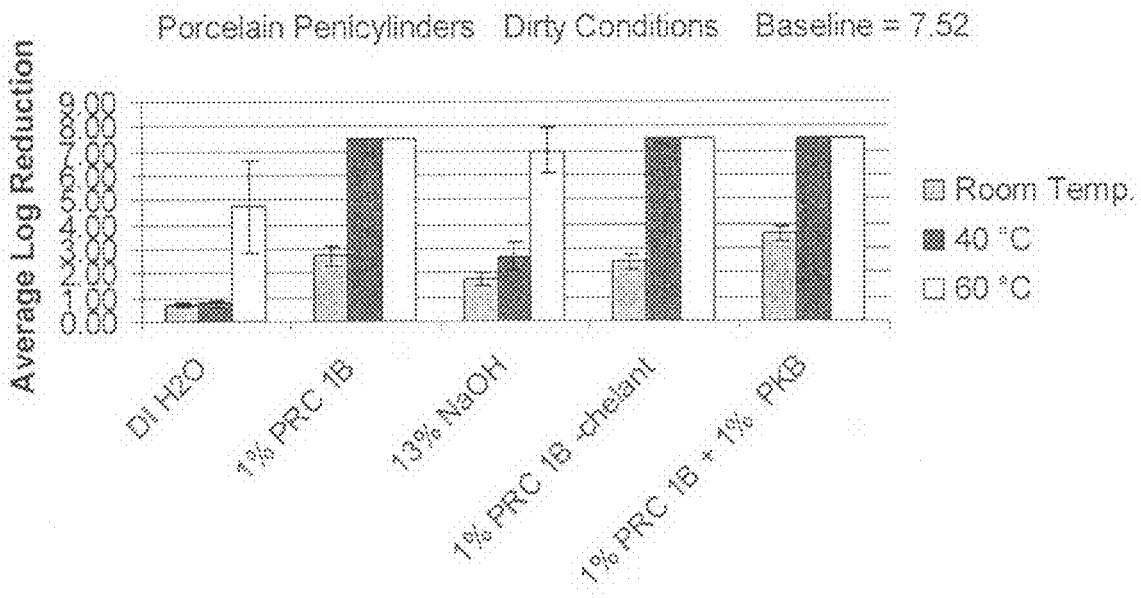
FIG. 1 is a comparison of the inventive composition's antimicrobial activity with that obtained using deionized water or 13% NaOH alone, the inventive composition without a chelant, and the inventive composition with a booster additive, under varying temperature conditions.

The invention is directed to an improved aqueous alkaline cleaning composition for removing hydrophobic soils from surfaces and equipment, which is stable over the expected shelf life, low foaming and also has unexpectedly enhanced disinfectant (antimicrobial), including virucidal, activity. The improved alkaline cleaning composition(s) of the invention comprise both biodegradable surfactants and biodegradable chelating agents.

The inventive cleaning composition comprises sodium hydroxide as a source of both alkalinity and antimicrobial efficacy. The preferred concentrated composition contains a source of alkalinity, specifically sodium hydroxide (50% active), in the range of from about 25 to about 40 wt. %. Sodium hydroxide is registered for use as a herbicide, fungicide, algaecide and as a disinfectant under various settings by the United States Environmental Protection Agency (EPA) (EPA R.E.D. Facts for Sodium Hydroxide, EPA-738-F-92-008, September 1992). The presence of sodium hydroxide acts not only as the source of alkalinity for the formula, but also assists in cleaning performance through both solubility and alkaline hydrolysis (saponification) mechanisms. Alternatively, potassium hydroxide (46% active) in the same ranges as sodium hydroxide may be used as the source of alkalinity; however, potassium hydroxide is not considered to be an EPA active ingredient. Nonetheless, the advantages of the invention may be achieved through the use of potassium hydroxide alone, or in combination with sodium hydroxide. When used in combination, the range for the source of alkalinity is from about 35 to about 55 wt. %, based upon the total weight of the aqueous alkaline cleaning composition.

A synergistic combination of surfactants is employed in the aqueous alkaline cleaning compositions in the range of from about 4 to about 20% by weight, based upon the total weight of the aqueous alkaline cleaning composition. The surfactant system combination of the invention has significant advantages, such as being readily biodegradable, low-foaming, UV-analyzable, and stable in a high pH (13-14) throughout the entire shelf-life of the product. The surfactant system employed in the invention is a combination comprising nonionic surfactants for the removal of hard or difficult-to-clean soils; a hydrotrope or combination of hydrotropes to solubilize these surfactant(s) in the aqueous alkaline solution; and a surfactant having a chromophore UV-analyzable function. The selected combination of surfactants and hydrotropes must be biodegradable.

The nonionic surfactants are preferably, but not limited to, primary or secondary alcohol ethoxylates, other alcohol alkoxylates, modified ethoxylates, ethylene oxide/propylene oxide (EO/PO) block copolymers, alkyl phenol ethoxylates, and blends thereof, preferably, but not limited to, $C_8$-$C_{18}$ alcohol ethoxylates with less than 12 moles of ethylene oxide (EO). Typical examples are commercially available under the trade names: Triton DF 20, Triton X114, Tergitol 15-S-3, Tergitol 15-S-5, Tomadol 91-2.5, Tomadol 1-3, Berol 508, Berol 505, Berol 260, Berol 840, Berol DGR81, Berol LFG61, Neodol 91-2.5, Neodol 91-5, Neodol 1-2.5, Neodol 1-5, Deionic LF-EP-25, and DeTerge CS45LF. Tomadols are commercially available from Tomah Products Inc.; Tergitols and Tritons are commercially available from Dow; Berols are commercially available from Akzo Nobel; Neodols are commercially available from Shell Chemical Company; and Delonics and DeTerges are commercially available from DeForest Chemical Company. Surfactants useful in the invention must be biodegradable. The selected surfactant may function as the UV-analyzable component of the composition.

The amount of nonionic surfactants useful in the inventive composition's concentrated form is generally from about 2% to about 20% by weight, preferably from about 4% to about 15% by weight, and more preferably from about 8% to 12% by weight, based upon the total weight of the concentrated alkaline cleaning composition.

Alternatively, certain amphoteric surfactants, such as a betaine or dipropionate and/or anionic surfactant, such as modified ethoxylate, in amounts ranging from about 1% to about 10% by weight may be used in place of, or in conjunction with, the components of the above described surfactant system.

The hydrotrope surfactants utilized in the present invention are generally hydrophilic compounds, but may be hydrophobic, and one or more different classes of hydrotropes can be utilized. Hydrotropes are generally defined having the ability to increase the water solubility of slightly soluble organic compounds. They also impart shelf life stability to the aqueous, alkaline cleaning composition. The hydrotropes useful in the invention for coupling the hydrophobic surfactant into water are preferably alkyl glucosides, alkyl polyglucosides or aryl ethoxylates, such as, but not limited to, the Glucopon series from Cognis, or the Berol AG 6202, Berol AG 6206 or Ethylan HB4 from Akzo Nobel.

Another class of hydrotropes includes the various modified carboxylic acids or carboxylates that generally contain an alkyl group having from about 6 to about 18 carbon atoms. An example is an active sodium salt of a modified carboxylic acid, sodium alkanoate, known as DeTrope SA45 from DeForest, a proprietary compound that has low foaming properties, is biodegradable and is non-phenolic. A 100% active modified carboxylate is DeTrope CA-100, also a proprietary compound that also functions as a corrosion inhibitor. Other useful hydrotropes include various organic nitrogen containing compounds, such as amino compounds as for example a complex of coco imino glycinate, a complex of coco imino dipropionate, or an octyl amino dipropionate, respectively available as Ampholak XKE, Ampholak YCE, and Ampholak YJH40 made by AKZO Nobel of Boxmeer, the Netherlands, octyl dimethylamine oxide and disodium 2-ethylhexylimino dipropionate.

Hydrotropes may be present in the claimed composition(s) as a mixture of hydrotropes. The amount of one or more hydrotropes in the aqueous alkaline cleaning composition generally ranges from about 1 to about 10% by weight, preferably from about 2 to about 8% by weight, and more preferably from about 3 to about 6% by weight, based upon the total weight of the concentrated alkaline cleaning composition.

A surfactant with a UV-analyzable function that is also biodegradable and does not contain phosphorus compounds is an essential component of the formula. Such surfactants are utilized to verify or validate the effectiveness of a rinse cycle after the surfactant composition has been applied to a residue. The utilization of a UV analyzable surfactant synergistically improves the stability of the aqueous alkaline cleaning composition and cleaning performance. Though analyzability at low limits can be achieved using a variety of test methods, including conductivity, total organic carbon analysis (TOC), nuclear magnetic resonance (NMR), and capillary electrophoresis, the preferred method is high performance liquid chromatography (HPLC) with a UV detector.

A preferred example of a surfactant that is HPLC/UV-analyzable is sodium xylene sulfonate, an anionic surfactant that also has useful hydrotropic activity. Phosphorous containing compounds are not desired due to their impact on water system eutrophication and the resulting negative impact on the environment. Preferable, analyzable surfactants include sodium xylene sulfonate, sodium naphthalene sulfonate, dodecylbenzenesulfonic acid (Stepan), Ethylan HB-4 (Akzo-Nobel), and Triton X-114, Triton X-100, Triton X-45 and Triton X-35 (Dow). As with all other surfactants in the aqueous alkaline cleaning composition, the UV-analyzable surfactant must be biodegradable.

Examples of other UV-analyzable compounds useful in the invention include phenol alkyloxides having a plurality of alkylene oxide groups such as from about 1 to about 20 with from about 2 to about 16 being desired and about 3 to about 6 groups, with 4 being highly preferred. The alkylene oxide repeat units can contain 2, 3, or 4 carbon atoms with 2 carbon atoms and 1 oxygen atom, i.e., ethylene oxide groups, being preferred. The phenol group can optionally be substituted with from 1 or 2, desirably 1 alkyl group(s) each, independently, containing from about 1 to about 12 and desirably about 6 to about 10 carbon atoms, such as for example octyl and nonyl phenol ethoxylates wherein the moles of ethoxylation can generally vary from 1 to about 16. Examples of specific nonyl phenol ethoxylates include Igepal CO 210 (1.5 moles of ethoxylation), Igepal CO 530 (6 moles of ethoxylation), Igepal CO 630 (9.3 moles of ethoxylation), and Igepal CO 730 (15 moles of ethoxylation). The Igepal compounds are made by Stepan Corporation. Another useful UV-analyzable surfactant is phenol alkoxylate with 4 moles of ethylene oxide, available as Ethylan HB4 made by Akzo-Nobel. Preferably the UV-analyzable surfactant contains no substituted alkyl groups.

The ultraviolet light wavelength for detection of the presence of any residual UV analyzable surfactant such as in rinse water is approximately 200 to about 290 nanometers, desirably from about 215 to about 275, and preferably about 220-225 nanometers.

The amount of the one or more UV analyzable surfactants is generally from about 0.1% to about 8% by weight, preferably from about 1% to about 5% by weight, and more preferably from about 2% to about 4% by weight, based upon the total weight of the concentrated alkaline cleaning composition.

The composition preferably contains a biodegradable chelating agent, which has been shown in multiple studies to have a positive impact on cleaning performance. The chelating agent interacts with metal ions that the composition may come in contact with during use. The chelating agents assist with both hard water tolerance and cleaning performance. Preferable biodegradable chelating agents are preferably, but not limited to, the Trilon series from BASF, which are methylglycine diacetic acids and derivatives thereof; Baypure CX series from Lanxess, which are iminodisuccinic acids and derivatives thereof; the Octaquest series from Octel, which are ethylenediamine-disuccinates, and derivatives thereof; and the DeQuest series from Solutia, which are carboxymethyl inulin, and derivatives thereof. Specifically, Baypure CX 100, Baypure CX-34 (iminodisuccinic acid tetrasodium salt), Octaquest E30, DeQuest SPE 156225 (carboxymethyl inulin, sodium salt), Trilon M (methylglycine diacetic acid, trisodium salt), and DeQuest BP series, such as DeQuest BP 11625, (ethylenediasportic acids) have been shown to be useful The composition may optionally contain corrosion inhibitors. Examples of corrosion inhibitors include, but are not limited to, tolyltriazoles, benzyltriazoles, and their blends, and specialty surfactants with specific corrosion inhibition properties.

The composition may optionally contain anti-redeposition agents. Examples of anti-redeposition agents include, but are not limited to, polyacrylic acid, sodium polyacrylate, sodium gluconate, sodium lignosulfonate, and copolymers of malic and acrylic acid of various molecular weights.

The composition may optionally contain foam depressants depending on the application, although the aqueous alkaline formulation according to the invention is low foaming.

The components of the inventive compositions are preferably mixed in the following order: water, surfactants, hydrotropes, alkalinity source, chelating agents, and optional additives, although the order of mixing may vary depending on the components selected.

The inventive compositions, as described above, are alkaline and have a pH of about 13-14 for the concentrated form and a pH of about 12-13 when diluted. The compositions are very stable, low-foaming and biodegradable. Non-biodegradable surfactants and other components are toxic to aquatic life and can make oil and grease removal difficult.

A distinct advantage of the present invention is that verification of the removal of the cleaning compositions can readily be determined due to inclusion of a UV-analyzable surfactant. For example, the rinse water is analyzed by swabbing a substrate surface and obtaining rinse water therefrom, or by obtaining an aliquot of the last rinse water and measuring for any remaining cleaning composition using high performance liquid chromatography. The swab recovery or rinse water solution can be injected onto a reverse phase column where the UV-analyzable surfactant, such as sodium xylene sulfonate or Ethylan HB4, can be eluted as a single chromatographic peak using isocratic mobile phases of acetonitrile-water or methanol-water. The analyte can be detected, as it elutes from the column using a standard UV detector set to measure analyte absorbance at specified wavelengths, specific to each analyte. Naturally, if any cleaning composition is detected, the substrate is further rinsed and retested. The substrate is generally considered to be cleaned when the verification test of any cleaning composition remaining in the rinse water or swab is generally less than about 20 parts and desirably less than about 10 parts per million (ppm). That is, the peak at the specified wavelength is generally non-existent. Utilization of the cleaning compositions of the present invention thus eliminates any need to obtain rinse water samples and subject the same to chemical analysis which can require many minutes and even hours to conduct. It also is a validatable cleaning method that is customer friendly since it dramatically reduces downtime and is compliant to the demands of the regulatory agencies.

A further advantage of the present invention is that it has been demonstrated to have unexpectedly enhanced antimicrobial, including virucidal, efficacy, as compared to the use of any of the components alone. As a result, the use of the claimed composition(s) results in the saving of time and costs by eliminating the need for additional components or an additional sanitizing or disinfecting step after the cleaning process is complete.

Yet another decided advantage of the present invention is that the aqueous cleaning compositions are free of various phosphorous containing compounds, such as phosphonates, phosphates and the like. Phosphorous is a nutrient for plant growth and when present in excess concentrations in water, eutrophication, or excess algae growth, tends to occur leading to severe deterioration of water body quality.

The production of the concentrated form of the aqueous alkaline cleaning composition is desired with regard to initial storage, transportation and any subsequent storage before use. As discussed above, the cleaning compositions of the present invention surprisingly yield synergistic results with regard to cleaning performance and stability and give unexpected results with respect to their disinfectant, including virucidal properties, than could be achieved with any component alone.

The composition may be used alone, or in combination with an acid cleaner or neutral pH cleaner, or in combination with various disinfectant agents, although additional components are not required in order to achieve the advantages of the invention. The compositions provide superior cleaning when applied to numerous substrates, such as hard surfaces, articles, equipment and the like to remove various product residues (soils). Examples of substrates include but are not limited to chemical reaction vessels, treatment equipment, pharmaceutical containers and equipment, medical equipment, surgical instruments, food and foodstuffs and processing equipment therefore, and various types of personal care and cosmetic items, such as mascara, diaper ointment, sunscreens, aftershaves, lip balm, skin care lotions, creams, hair conditioners and gels and other waterproof products. Other substrates include various storage vessels, tanks, pipes, pumps, valves, heat exchangers, driers, and the like. The cleaning composition can be applied to the substrates in any conventional manner, such as by brushing, spraying coating, and the like, or the substrate can be submerged in the cleaning composition with optional agitation.

The cleaning compositions of the invention also have superior cleaning properties and are effective with regard to materials that leave a residue upon drying or baking. Residues include, but are not limited to, polymers, such as high molecular weight homo- or copolymers; resins, such as vegetable derived mixtures of carboxylic acids, oils, terpenes, and other residues from plants or animals, gums, varnishes, adhesives, rosins, and the like; thickening agents; modified or natural materials of the cellulose family, such as hydroxylpropyl methyl cellulose; natural gel such as alginates, pre-gelatinized starch and the like. Still other residues are derived from proteinaceous materials, such as mucous, blood, eggs and the like.

Once the cleaning compositions of the present invention have been applied to the residue and/or substrate in the manner noted above, they are allowed to wet the residue by soaking, scrubbing, impregnating, saturating, etc. After a sufficient amount of time at a desired temperature and concentration, which are generally readily predetermined according to customary use and application, the substrate is rinsed at least once, preferably with water, although other suitable solvents can be utilized, and the residue is removed.

The invention will be better understood by reference to the following examples, which serve to explain but not to limit the scope of the invention.

EXAMPLES

The examples demonstrate the unique properties of the inventive alkaline cleaning compositions, including among other things, superior cleaning performance, low-foaming propensity, and antimicrobial, including virucidal, activity.

Example 1

Antimicrobial/Virucidal Efficacy

PRC 1B Formulation: The following composition was tested:

| RM Name | Wt. % | Function |
|---|---|---|
| Berol 505 | 2.0% | Nonionic Surfactant/Alcohol Ethoxylate |
| Berol 508 | 1.0% | Nonionic Surfactant/Alcohol Ethoxylate |
| AG 6206 | 4.0% | Nonionic Surfactant - Alkylglucoside/ Hydrotrope/75% Active |
| Sodium Hydroxide (50%) | 26.0% | Active Ingredient Disinfectant Claims/ Source of Alkalinity |
| Sodium Xylene Sulfonate (40%) | 2.5% | Anionic Surfactant - Hydrotrope/ Analyzable Surfactant |
| Trilon M (Trisodium Methylglycinediacetic Acid - 40%) | 10% | Chelating Agent |
| Water | 54.5% | Solvent |

The above example of the inventive compositions was tested under hospital grade disinfectant (test conditions: 1%@60° C., 250 ppm hard water, 5 minutes). The two studies for the virucidal/poliovirus efficacy used different conditions (Test Condition 1: 1%@60° C., 250 ppm hard water, 10 minutes; Test Condition 2: 3%@ RT, DI Water, 30 minutes). Observed results indicated that the composition met hospital grade disinfect and virucidal requirements as stipulated by the EPA. Label claims for use of disinfectants in hospital or medical environments are acceptable only for those products that are effective against both gram positive and gram negative bacteria, including but not limited to the nocosomial pathogen *Pseudomonas aeruginosa* (Table 2). In addition, the inventive composition has been shown to be virucidal by demonstrating activity against poliovirus (Table 3). The EPA requires adequate data developed through the use of any virological technique recognized as technically sound, to permit labeling as a virucide.

Bactericidal testing was performed utilizing a modification of the AOAC Official Methods 955.14, *Use-Dilution Methods: Testing Disinfectants Against Salmonella Choleraesuis*, 955.15, *Testing Disinfectants Against Staphylococcus Aureus*, and 964.02, *Testing Disinfectants Against Pseudomonas Aeruginosa* (15$^{th}$ Edition, 1990), as specified by the U.S. Environmental Protection Agency requirements set forth in the *Pesticide Assessment Guidelines, Subdivisions G: Product Performance*. This method modifies the use-dilution test to facilitate a shorter pre-test incubation time, followed by a sonication and vortex step that allows for quantification of the surviving bacteria on the carrier. This differs from the official qualitative AOAC method by providing true bacterial counts, but maintains the key components of carrier type, inoculation technique, disinfectant exposure and neutralization. Table 1, below, summarizes the achieved microbiological data:

TABLE 1

| CLAIM | CONDITIONS | RESULT |
|---|---|---|
| Hospital Grade Disinfectant *S. aureus*, *S. choleraesuis*, *P. aeruginosa* | 1%, 250 ppm hard water 60° C., 5 minutes, with 5% Fetal Bovine Serum Soil Load | PASS |
| Virucidal Poliovirus | 1%, 60° C., 10 min., 250 ppm Synthetic hard water, with 5% Fetal Bovine Serum Soil Load 3%, RT, 30 min. DI water, with O.L. | PASS - Complete inactivation |

Suspensions of the above bacteria were used to inoculate/contaminate 60 stainless steel penicylinders per bacteria per lot of product. The penicylinders were then treated with three different lots of the same product, one of which was at least 60 days old. A total kill on fifty-nine (59) out of sixty (60) inoculated and exposed carriers per product configuration is required to demonstrate effectiveness against the test species under these test conditions. Results achieved are shown below in Table 2.

TABLE 2

| Microorganism Species | Product Batch | Number of Positive Carriers Total Number of Carriers Tested |
|---|---|---|
| *Staphylococcus aureus* (ATCC # 6538) | 1 (Lot # 6233-73) | 0/60 |
| | 2 (Lot # 6233-83) | 1/60* |
| | 3 (Lot # PTR06007) | 1/60* |
| *Pseudomonas aeruginosa* (ATCC # 15442) | 1 (Lot # 6233-73) | 0/60 |
| | 2 (Lot # 6233-83) | 1/60* |
| | 3 (Lot # PTR06007) | 0/60 |
| *Salmonella enteric*, *Serovar Choleraesuis* (ATCC # 10708) | 1 (Lot # 6233-73) | 0/60 |
| | 2 (Lot # 6233-83) | 0/60 |
| | 3 (Lot # PTR06007) | 0/60 |

*Isolation streaks and gram-stain confirmed presence of the challenge strain.

The virucidal efficacy of the inventive composition against Poliovirus type 1 was evaluated using test criteria and methods approved by the United States Environmental Protection Agency for registration of a product as a virucide. Films of Poliovirus type 1 were prepared in sterile glass Petri dishes and dried. Dried films were treated with each lot of the test substance. The 50% Tissue Culture Infectious Dose is calculated in Table 3 below.

TABLE 3

| Dilution | Dried Input Virus Control (Group A) | Dried Virus Control (Reference Temperature Value (Group A) | Poliovirus type 1 + Lot # 6233-83 (Group B) | Poliovirus type 1 + Lot # PTR06007 (Group B) |
|---|---|---|---|---|
| Cell Control | 0 0 0 0 | 0 0 0 0 | 0 0 0 0 | 0 0 0 0 |
| $10^{-1}$ | + + + + | + + + + | 0 0 0 0 | 0 0 0 0 |
| $10^{-2}$ | + + + + | + + + + | 0 0 0 0 | 0 0 0 0 |
| $10^{-3}$ | + + + + | 0 0 0 + | 0 0 0 0 | 0 0 0 0 |
| $10^{-4}$ | + + + + | 0 0 0 + | 0 0 0 0 | 0 0 0 0 |
| $10^{-5}$ | + + + + | 0 0 0 + | 0 0 0 0 | 0 0 0 0 |
| $10^{-6}$ | + + + + | 0 0 0 0 | 0 0 0 0 | 0 0 0 0 |
| $10^{-7}$ | 0 0 0 0 | 0 0 0 + | 0 0 0 0 | 0 0 0 0 |
| $10^{-8}$ | 0 0 0 0 | 0 0 + 0 | 0 0 0 0 | 0 0 0 0 |
| $TCID_{50}$/0.1 Ml | $10^{6.5}$ | $10^{3.75}$ | $\leqq 10^{0.5}$ | $\leqq 10^{0.5}$ |

In addition to the EPA standard tests listed above, detailed experimental studies were performed on the inventive compositions. Tests were done using the aforementioned modified version of the AOAC Use Dilution Test, to quantify the number of viable bacteria remaining on the stainless steel penicylinders. An overview of the test results are shown in FIG. 1. FIG. 1 data supported the primary unexpected result that the composition's antimicrobial activity did not come from the temperature or NaOH alone, but rather as a result of the synergistic combination of the selected components.

Example 2

Effect of Temperature/Ingredients

Figure 2:
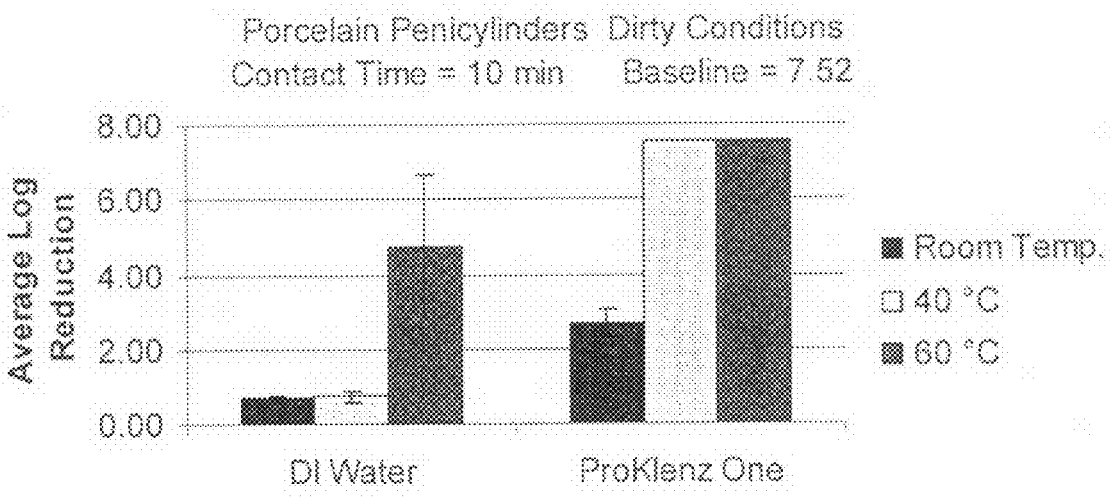
FIG. 2 shows the antimicrobial activity achieved with the inventive composition and reflects that temperature alone is not responsible for the enhanced effects.

In order to confirm that the antimicrobial activity was not solely attributable to elevated temperature, the aqueous alkaline cleaning composition was compared to hot DI (deionized) water. FIG. 2 reflects the data obtained by the comparison and demonstrates that the synergistic combination of components was responsible for the enhanced antimicrobial activity and not simply an elevated temperature.

Figure 3:
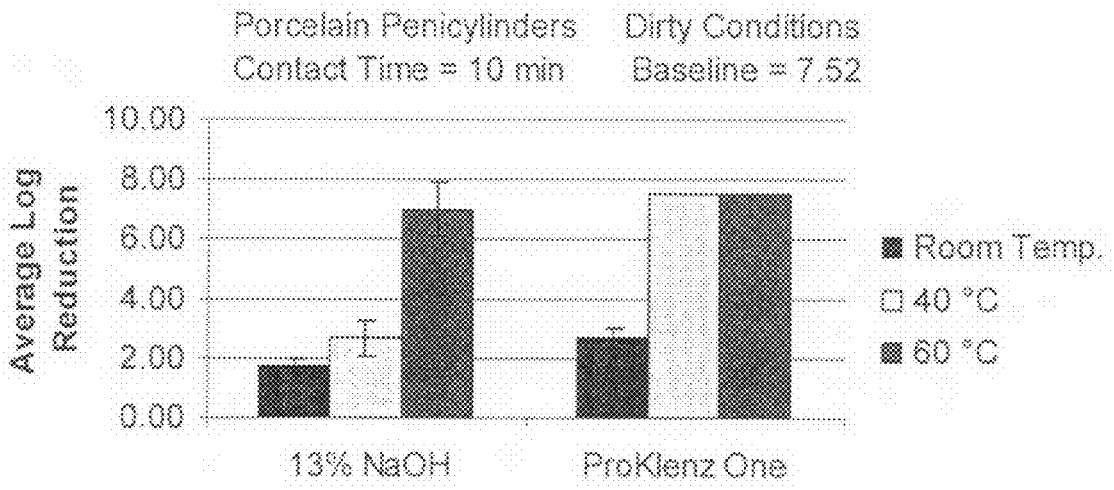
FIG. 3 shows the antimicrobial activity achieved with the inventive composition and reflects that NaOH alone is not responsible for the enhanced effects, regardless of temperature.

In order to confirm further that the antimicrobial activity was not solely attributable to alkalinity, the inventive composition was compared to a sodium hydroxide control containing the same active percentage as the composition. FIG. 3 reflects the data obtained by the comparison and demonstrates that NaOH alone is not responsible for the enhanced antimicrobial activity.

Table 4, below, shows results obtained which clearly indicated that the achieved microbiological efficacy is the result of the entire composition comprising NaOH, chelant, surfactants, and hydrotrope, and the applied temperature. At room temperature (RT), all the tested compositions showed limited microbiological efficacy. When the temperature was increased from RT to 40 and 60° C., i.e., at use conditions, the composition of the invention showed a total kill. Results demonstrated that the inventive composition achieved antimicrobial efficacy against *S. aureus* at 40° C., whereas neither the individual components of the composition (water, NaOH (13%)) nor the removal of the chelant from the inventive composition achieved the same efficacy at the specified temperature. (Organism: *S. aureus* ATCC 6538, in presence of 5% Fetal bovine serum soil load, stainless steel (SS) penicylinders, Contact time: 10 min., 10% of the product.)

TABLE 4

| | Average Log Reduction | | | |
|---|---|---|---|---|
| Temperature | Water | 13% NaOH | Formulation without Chelant | Formulation |
| RT | 0.69 | 1.76 | 2.46 | 2.70 |
| 40° C. | 0.76 | 2.69 | 7.52 | 7.52 |
| 60° C. | 4.74 | 7.00 | 7.52 | 7.52 |

Example 3

Effect of Concentration and Time

Table 5 shows the activity of the inventive composition in the presence of 5% fetal bovine serum soil load at room temperature with inoculated stainless steel penicylinders. Starting populations are listed in parentheses.

TABLE 5

| Organism | Contact Time (Min.) | Log Reduction for 1% of the Product | Log Reduction for 3% of the Product |
|---|---|---|---|
| *S. aureus* ATCC 6538 | 10 | 3.23 (7.51) | 7.51 (7.51) |
| | 20 | N/A | 6.88 (6.88) |
| | 30 | 5.52 (7.51) | 7.51 (7.51) |
| *P. aeruginosa* ATCC 15442 | 10 | 7.82 (7.82) | 7.82 (7.82) |
| | 20 | N/A | 7.89 (7.89) |
| | 30 | 7.82 (7.82) | 7.82 (7.82) |
| *S. enterica* ATCC 10708 | 10 | 7.93 (7.93) | 7.93 (7.93) |
| | 20 | N/A | 7.99 (7.99) |
| | 30 | 7.93 (7.93) | 7.93 (7.93) |

The above results indicate that, at temperatures lower than 60° C., the inventive composition achieved excellent results with increased contact time. With increased contact time or increased concentration, antimicrobial activity is improved even at room temperature, demonstrating versatility of the formulation.

By testing characteristic gram positive and gram negative bacteria, an assumption can be made that the inventive composition will perform similarly against bacteria with similar anatomy and physiological structures. While sodium hydroxide is known to be active against bacteria, the present invention demonstrated for the first time the capability of enhancing that activity through formulation design, thus enabling the production of an aqueous alkaline cleaning composition that met EPA disinfection standards through optimizing various use conditions, such as time, temperature and concentration.

Example 4

Impact of Soil

The data above strongly suggested that the inventive composition worked well in the presence of organic material such as a bovine serum soil load.

Example 5

Foaming Studies

The inventive composition is considered low-foaming, as proven in studies using both a graduated cylinder shaking test, and in high-impingement washers. In the graduated cylinder shaking test, a solution of the composition was shaken vigorously for one minute at a specific temperature (60° C.), the amount of foam was measured, and the foam characteristics were monitored. In the high-impingement washer test, a given concentration of the composition was added to the wash cycle of the washer, the amount of foam was observed, and the pressure drop in the washer was monitored. The amount of foam (if any) upon completion of the cycle was noted. In all studies, the inventive composition showed low foaming characteristics (low foam generated, and foam was unstable) that was similar to other conventional cleaning products.

The following table (Table 6) shows foam heights measured using the graduated cylinder shaking test of different products (including the inventive compositions), tested at 1% w/w dilution at room temperature (~22° C.). Table 6 shows that all products tested had some initial foam, but only CIP 100 and PRC 1B had fast-breaking foam (as seen by comparing initial results to results at 15, 30 and 60 seconds).

TABLE 6

Comparative foam profile of various cleaning compositions

| Product | Initial Foam (mL) | Foam Remaining After 15 Seconds (mL) | Foam Remaining After 30 Seconds (mL) | Foam Remaining After 60 Seconds (mL) |
|---|---|---|---|---|
| ProKlenz ONE | 50 | 10 | 5 | 5 |
| CIP 100 | 25 | 5 | 5 | 5 |
| CIP 100 + CIP Additive | 30 | 30 | 30 | 30 |
| COSA CIP 92 | 35 | 30 | 25 | 15 |

dry. The percentage of soil removed was determined gravimetrically by the difference in weight before and after cleaning.

Twelve (12) soils were screened (market of interest given in parenthesis): Rhodorsil Fluid 47 V 30,000 (Parenteral), Sesame Oil (Final Dose), Nursoy Soybase (Nutritional), Zinc Oxide 10% Diaper Rash Ointment (Topical), Men's Expert Comfort MAX SPF15 (Personal Care), Egg Fluids (Biotech), Chapstick (Personal Care), Mineral Ice (Topical), Simethicone, Human Plasma (Biotech). Table 7 below shows the soils were cleaned by the various cleaning products (complete cleaning given as a "√"). PRC 1B was the inventive composition of Example 1.

TABLE 7

| Soil | DI Water Alone | CIP 100 (3%) | CIP 100 + CIP Add. (1.5% + 1.5%) | CIP 100 + CIP Add. (3% + 3%) | PRC 1B (3%) |
|---|---|---|---|---|---|
| Simethicone | ✓ | ✓ | ✓ | ✓ | ✓ |
| Rhodorsil Fluid 47 V 30,000 | — | ✓ | ✓ | ✓ | ✓ |
| Sesame Oil | — | ✓ | — | ✓ | ✓ |
| Mineral Ice | — | ✓ | ✓ | ✓ | ✓ |
| Nursoy Soybase | — | ✓ | ✓ | ✓ | ✓ |
| $ZnO_2$ Diaper Rash Ointment | — | — | — | — | ✓ |
| Human Plasma | — | ✓ | ✓ | ✓ | ✓ |
| Egg Fluids | — | ✓ | ✓ | ✓ | ✓ |
| Chapstick | — | — | ✓ | ✓ | ✓ |
| After Shave Balm | — | ✓ | ✓ | ✓ | ✓ |

Cleaning studies show similar performance independent of the alkalinity source (NaOH vs. KOH).

Rinsability studies were performed using a myriad of different techniques: HPLC, total organic carbon (TOC), inductively-coupled plasma (ICP), conductivity and pH. The studies showed that NaOH or KOH in the formula rinse off at the same rate, and that selective absorption of ingredients does not occur.

CIP 100 is a potassium-hydroxide based alkaline cleaner manufactured by STERIS Corporation formulated for use in the Process Research Cleaner (PRC) market. CIP Additive is a high surfactant based system manufactured by STERIS Corporation for the PRC market that is used in conjunction with other cleaners (both acidic and alkaline) to boost cleaning performance, when needed. COSA CIP 92 is an alkaline cleaner manufactured by Ecolab for use in the PRC market.

Example 6

Cleaning Studies

Cleaning studies were performed comparing the Example 1 inventive composition to STERIS CIP 100 (at 3%) and CIP 100+CIP additive (at two different levels). The cleaning studies were conducted by applying the soil onto stainless steel coupons in a thin film, followed by drying at various times and conditions (depending on the soil and/or customary use conditions). The cleaning solutions (aqueous) were prepared, and the soiled stainless steel coupon was immersed in the aqueous solution for the desired cleaning time, with a little agitation provided by a magnetic stir bar. At the end of the cleaning, the stainless steel coupon was removed and rinsed with a controlled flow and amount of water, and allowed to Table 7, above, shows cleaning performance of different cleaners (alone or in combination) achieved at different concentrations against common soils used in the cosmetic and pharmaceutical industries. Deionized water alone could only clean one soil completely. CIP 100 at 3% concentration cleaned 8 of the 10 soils and CIP 100+CIP Additive (both at 1.5%) cleaned 8 of the 10 soils. CIP 100+CIP Additive at 3%+3% cleaned 9 out of the 10 soils. Only PRC 1B (the inventive composition) cleaned all 10 soils effectively, and significantly and, unexpectedly, a "surfactant booster" product was not needed.

As demonstrated by the above examples, the inventive composition offers significant advantages to the prior art in that the product exhibits enhanced disinfectant, including virucidal, activity within normal use concentrations at ambient and elevated temperatures based on the level of sodium hydroxide in the composition in combination with synergistic components, such as the surfactant system, including hydrotrope, and chelating agent. The inventive compositions are intended to be used at temperatures 40-80° C. and were also demonstrated to have superior cleaning ability at these temperatures and at room temperature against a wide range of hard-to-clean soils.

The inventive compositions of the present invention are unique because they utilize a known antimicrobial ingredient, namely sodium hydroxide, with a synergistic combination of surfactants, hydrotropes (coupling agents) and chelating agents and achieved superior cleaning performance, stability over an expected shelf life, and unexpectedly enhanced antimicrobial, including virucidal, efficacy. As demonstrated, the results were due to the combination of ingredients in the composition and cannot be accomplished through mere alteration of test conditions or single ingredients alone. The antimicrobial activity is achieved without the addition of known sanitizing or disinfecting components or a separate sanitizing or disinfecting step in the cleaning process. The inventive compositions also provide the ability to analyze directly the detergent or cleaning residue on the tanks, vessels or other equipment or surfaces, to aid the customer who desires or is required to validate its cleaning process. Finally, these benefits are all offered in one aqueous, alkaline cleaning composition containing biodegradable components and, as such, is environmentally friendly.

The inventive compositions have a number of applications and are intended to be used in pharmaceutical, personal care, food, and cosmetics manufacturing industries, among others, to clean and disinfect manufacturing tanks, vessels, pipes and other equipment and hard surfaces.

In accordance with the patent statutes, the best mode and preferred embodiment have been set forth; the scope of the invention is not limited thereto, but rather by the scope of the attached claims.

What is claimed is:

1. An aqueous, low-foaming alkaline cleaning composition, comprising:

a. sodium hydroxide (50% active) present in an amount of at least about 25 wt. %;

b. at least two biodegradable non-ionic surfactants that are primary or secondary alcohol ethoxylates, present in an amount ranging from 3 to about 10 wt. %;

c. a UV-analyzable surfactant comprising sodium xylene sulfonate (40%), present in an amount ranging from about 2.5 to about 5 wt. %;

d. a biodegradable chelating agent comprising methyiglycine diacetic acid present in an amount of about 10 wt. %; and e. water in an amount sufficient so that the total weight of components of the cleaning composition adds up to about 100 wt. %, wherein the cleaning composition is biodegradable, phosphate-free, stable for an unexpected shelf life, low-foaming, and capable of being validated using known UV detection techniques, and wherein the cleaning composition has disinfectant properties when used alone, without the need for additional sanitizers or disinfecting components, or separate sanitizing or disinfecting steps.

* * * * *